US012644248B2

(12) United States Patent
Zhang et al.

(10) Patent No.: US 12,644,248 B2
(45) Date of Patent: Jun. 2, 2026

(54) SELF-MAINTAINING AND ANTI-SCOURING DEVICE FOR OFFSHORE WIND POWER PILE FOUNDATION

(71) Applicants: Shanghai Investigation, Design & Research Institute Co., Ltd., Shanghai (CN); China Three Gorges Corporation, Wuhan (CN)

(72) Inventors: Xu Zhang, Shanghai (CN); Shaowu Zhou, Shanghai (CN); Yifeng Lin, Shanghai (CN); Juan Jiang, Shanghai (CN)

(73) Assignees: Shanghai Investigation, Design & Research Institute Co., Ltd., Shanghai (CN); China Three Gorges Corporation, Wuhan (CN)

( * ) Notice: Subject to any disclaimer, the term of this patent is extended or adjusted under 35 U.S.C. 154(b) by 0 days.

(21) Appl. No.: 18/289,114

(22) PCT Filed: Oct. 26, 2022

(86) PCT No.: PCT/CN2022/127519
§ 371 (c)(1),
(2) Date: Oct. 31, 2023

(87) PCT Pub. No.: WO2023/151318
PCT Pub. Date: Aug. 17, 2023

(65) Prior Publication Data

US 2025/0084607 A1 Mar. 13, 2025

(30) Foreign Application Priority Data

Feb. 11, 2022 (CN) ..... 202210128323.3

(51) Int. Cl.
*E02D 37/00* (2006.01)
*E02D 31/06* (2006.01)

(52) U.S. Cl.
CPC ..... *E02D 31/06* (2013.01)

(58) Field of Classification Search
CPC ..... E02D 31/06; E02D 37/00; E02D 27/425; E02D 27/52; E02D 27/525; E02D 5/226;
(Continued)

(56) References Cited

U.S. PATENT DOCUMENTS 3,597,930 A * 8/1971 Rochelle ..... E02B 17/0017 405/211
3,763,656 A * 10/1973 Van Daalen ..... E02D 7/24 405/248

(Continued)

*Primary Examiner* — Edwin J Toledo-Duran
(74) *Attorney, Agent, or Firm* — IPRTOP LLC

(57) ABSTRACT

A self-maintaining and anti-scouring device for an offshore wind power pile foundation is provided. The self-maintaining and anti-scouring device comprises: a plurality of fixing parts configured to be fixedly disposed on seabed; an installation part disposed above the plurality of fixing parts and configured for installing wind power equipment; and a sand-screening part, comprising a sand-screening ring and an impeller both of which are disposed below the installation part, wherein a seawater inlet, a stirring chamber and a sand outlet are disposed on the sand-screening ring in sequence from a top to a bottom of the sand-screening ring, and a seawater outlet is disposed on a side surface of the sand-screening ring to communicate to the stirring chamber, wherein the impeller is rotatably disposed in the stirring chamber. The impeller is horizontally rotated in the sand-screening ring to separate sand and seawater in the stirring chamber through a centrifugal force.

8 Claims, 4 Drawing Sheets

(58) Field of Classification Search
CPC ..... E02D 3/02; E02D 27/44; E02D 27/12; E02D 31/00; Y02E 10/727; B04B 5/12
See application file for complete search history.

(56) References Cited

U.S. PATENT DOCUMENTS 3,842,917 A * 10/1974 Wisotsky ..... E02D 7/00 173/90
3,911,687 A * 10/1975 Mo ..... E02D 27/52 405/225
4,081,970 A * 4/1978 Dowse ..... E02D 29/06 405/204
4,086,866 A * 5/1978 Nixon ..... B63B 21/27 114/295
4,224,527 A * 9/1980 Thompson ..... F03B 17/06 290/43
4,257,721 A * 3/1981 Haynes ..... E02D 7/20 114/295
4,342,526 A * 8/1982 Mousselli ..... E02F 9/026 405/163
4,360,291 A * 11/1982 Cranberg ..... E02D 27/52 405/195.1
4,372,707 A * 2/1983 Ostgaard ..... E02D 7/20 405/199
4,397,586 A * 8/1983 Weiss ..... E02B 17/0017 405/211
4,407,606 A * 10/1983 Larsen ..... E02B 3/121 405/16
4,432,671 A * 2/1984 Westra ..... B63B 21/27 405/226
4,661,014 A * 4/1987 Aubert ..... E02D 17/20 405/21
4,664,557 A * 5/1987 Hodge ..... E02D 3/10 405/195.1
4,744,698 A * 5/1988 Dallimer ..... E21B 7/124 405/226
4,761,096 A * 8/1988 Lin ..... E02D 7/24 405/226
6,827,032 B1 * 12/2004 Wobben ..... E02B 17/025 114/230.1
10,094,091 B1 * 10/2018 Tesvich ..... E02F 3/9293
2005/0115248 A1 * 6/2005 Koehler ..... F17C 1/002 141/82
2009/0191004 A1 * 7/2009 Schakenda ..... E02B 17/00 405/232
2010/0183377 A1 * 7/2010 Fraenkel ..... E02D 27/52 405/232
2010/0224694 A1 * 9/2010 Wright, Sr. ..... F03D 13/25 239/2.1
2011/0070032 A1 * 3/2011 Frazier ..... E02D 29/10 405/210
2011/0158750 A1 * 6/2011 Reichel ..... E02B 17/02 405/205
2011/0158752 A1 * 6/2011 Hitchin ..... E02D 7/28 405/232
2011/0215650 A1 * 9/2011 Slocum ..... F03D 9/255 290/55
2012/0243945 A1 * 9/2012 Swingler ..... E21B 7/124 405/224
2012/0272614 A1 * 11/2012 Perner ..... E02D 27/42 52/745.17
2012/0282036 A1 * 11/2012 Taenaka ..... E02D 27/42 405/224.2
2013/0266453 A1 * 10/2013 Moiret ..... E02B 17/021 405/196
2014/0014388 A1 * 1/2014 Maier ..... E02B 17/025 174/37
2015/0071711 A1 * 3/2015 Wong ..... B63B 1/107 405/226
2015/0218770 A1 * 8/2015 Arslan ..... E02D 5/60 405/211
2015/0308401 A1 * 10/2015 Edwards ..... F03G 7/05 29/428
2015/0322642 A1 * 11/2015 Wu ..... E02B 17/027 405/224.1
2016/0208453 A1 * 7/2016 Larsen ..... E02D 13/04
2017/0268192 A1 * 9/2017 Biley ..... A01G 33/00
2018/0073665 A1 * 3/2018 Bombino ..... F16L 1/24
2019/0071839 A1 * 3/2019 Bauduin ..... E02D 31/00
2020/0230615 A1 * 7/2020 Melling ..... B04C 3/00
2020/0399851 A1 * 12/2020 Olsen ..... E02D 5/24
2021/0002146 A1 * 1/2021 Liberman ..... B01D 61/026
2021/0039116 A1 * 2/2021 Melling ..... B04B 5/10
2022/0275786 A1 * 9/2022 Shu ..... F03D 13/20
2023/0340745 A1 * 10/2023 Ogorchock ..... E02B 17/025
2024/0375752 A1 * 11/2024 Akers ..... E02D 27/525
2025/0075457 A1 * 3/2025 Scott ..... A63B 69/3691
2025/0171978 A1 * 5/2025 Edelmann ..... E02D 17/16

* cited by examiner

SELF-MAINTAINING AND ANTI-SCOURING DEVICE FOR OFFSHORE WIND POWER PILE FOUNDATION

FIELD OF TECHNOLOGY

The present disclosure relates to the technical field of pile foundation scour prevention, in particular, to a self-maintaining and anti-scouring device for an offshore wind power pile foundation.

BACKGROUND

Wind power generation is the fastest-growing green energy technology in the world. While land-based wind power farms are developing rapidly, people have already noticed some limitations of land-based wind energy utilization, such as large land occupation, noise pollution, and other issues. Due to the abundant wind energy resources at sea and the feasibility of offshore wind power technology, the ocean will become a rapidly developing wind power market. Offshore wind power farms in Europe and America are on the eve of large-scale development. The sea area within 50 meters deep along the eastern coast of China is vast and close to the power load center. With the development and maturity of offshore wind power farm technology, wind energy will become an important energy source of sustainable development for China's eastern coastal areas.

The offshore wind power pile foundation is a structure for supporting wind power equipment. When offshore wind power generators bear the scouring and impact of seawater, silt around their pile foundations will be scoured by seawater, resulting in the formation of scour holes. These holes will affect the stability of the wind power pile foundations and cause them to tilt or collapse. In existing technologies, the most common method for preventing the wind power equipment from tilting and collapsing is to reinforce the silt around their pile foundations. However, this method is difficult to implement and requires regular underwater maintenance.

SUMMARY

In view of this, the present disclosure provides a self-maintaining and anti-scouring device for offshore wind power pile foundation to solve the above-mentioned defects in the prior art.

A self-maintaining and anti-scouring device for an offshore wind power pile foundation, comprising: a plurality of fixing parts configured to be fixedly disposed on seabed; an installation part disposed above the plurality of fixing parts and configured for installing wind power equipment; and a sand-screening part, comprising a sand-screening ring and an impeller both of which are disposed below the installation part, wherein a seawater inlet, a stirring chamber and a sand outlet are disposed on the sand-screening ring in sequence from a top to a bottom of the sand-screening ring, and a seawater outlet is disposed on a side surface of the sand-screening ring to communicate to the stirring chamber, wherein the impeller is horizontally and rotatably disposed in the stirring chamber to separate sand and seawater in the stirring chamber through a centrifugal force, wherein the sand and the seawater are respectively discharged through the sand outlet and the seawater outlet, at which time sand-containing seawater enters the stirring chamber through the seawater inlet.

Preferably, the self-maintaining and anti-scouring device further comprises a plurality of sand-pressing parts and a lifting part, wherein each of the plurality of fixing parts is sleeved with one of the plurality of sand-pressing parts, wherein the lifting part is disposed below the installation part for driving the plurality of sand-pressing parts to ascend and descend.

Preferably, the lifting part comprises a hydraulic cylinder, a connecting plate, and a plurality of connecting rods, wherein a top of the hydraulic cylinder is fixedly connected to the installation part, a bottom of the hydraulic cylinder is fixedly connected to the connecting plate, and the connecting plate is fixedly connected to the plurality of sand-pressing parts through the plurality of connecting rods.

Preferably, the sand-screening part further comprises a waterproof motor and an installation seat, wherein the installation seat is fixedly disposed above the sand-screening ring through a plurality of supporting rods, wherein the installation seat is disposed below the connecting plate, and the waterproof motor is fixedly installed on the installation seat.

Preferably, the sand-screening ring is fixedly connected to the plurality of sand-pressing parts, and a bottom surface of the sand-screening ring is flush with those of the plurality of sand-pressing parts.

Preferably, a gap is formed between the impeller and the sand-screening ring, wherein a sand-blocking net is disposed in the gap along an axial direction of the sand-screening ring, and the sand-blocking net is disposed upstream of the seawater outlet.

Preferably, the seawater outlet is a strip-shaped slot disposed along a circumferential direction of the sand-screening ring.

Preferably, the number of the plurality of fixing parts is two or three, and each of the plurality of fixing parts is provided with a base for abutting against the seabed.

Preferably, each of the plurality of fixing parts comprises a stand column and a pre-embedded column, which are disposed and connected to each other along their common axial direction, wherein a bottom of the pre-embedded column is embedded into the seabed, and a top of the stand column is fixedly connected to the installation part.

Preferably, the installation part comprises an installation base, and the installation base, the stand column and the pre-embedded column are integrally formed.

The present disclosure has the following advantages:

1. The present disclosure adopts the method of adding sand to reinforce the wind power pile foundation. The sand-screening ring and the impeller are both disposed below the installation part. When the impeller rotates horizontally in the sand-screening ring, the sand-containing seawater in the stirring chamber of the sand-screening ring is carried along with the impeller and is separated into sand and seawater through the centrifugal force. The seawater can be discharged through the seawater outlet disposed on the side surface of the sand-screening ring under the action of the centrifugal force, while the sand gradually gathers on the inner surface of the sand-screening ring under the action of the centrifugal force, and falls onto the fixing parts through the sand outlet disposed at the bottom of the sand-screening ring under the action of the inner surface of the sand-screening ring. Thus, the wind power pile foundation is reinforced, and the detachment of the base layer around the fixing parts and the occurrence of the scour holes, both caused by the scouring and impact of seawater, are avoided. Thereby, the purpose of scour prevention can be achieved.

2. The present disclosure adopts the method of pressing the gathered sand around the wind power pile foundation to reinforce it. The lifting part is disposed below the installation part, and each of the fixing parts is sleeved with one sand-pressing part connected with the lifting part. When the sand separated from the sand-screening part falls to the periphery of the fixing parts of the wind power pile foundation, the lifting part can drive the sand-pressing parts to ascend and descend relative to the fixing parts, thus reinforcing the sand. Reinforcement of the wind power pile foundation can be achieved by the above method, and the base layer around the fixing parts can always be kept flat and dense, thereby avoiding workers' underwater work and reducing maintenance costs.

3. In the present disclosure, a strip-shaped seawater outlet is disposed along the circumferential direction of the sand-screening ring. After discharging the seawater in the sand-screening ring through the seawater outlet under the action of the centrifugal force, not only can the seawater's impact on the wind power pile foundation be offset, but also the seawater around the wind power pile foundation can be stirred and introduced into the stirring chamber, through the seawater inlet disposed at the top of the sand-screening ring, to realize the circulation flow of seawater inside and outside the stirring chamber, thus introducing the sand into the stirring chamber.

4. In the present disclosure, the sand-blocking net is disposed upstream of the seawater outlet. During the seawater stirring process, this sand-blocking net can block the sand in seawater from entering the seawater outlet, and make the sand gather and fall to the bottom of the wind power pile foundation, thereby reinforcing the wind power pile foundation.

5. The present disclosure adopts three fixing parts to support the installation part. The stability of the entire device can be improved by using the stability principle of a triangle together with an integral design of the fixing parts and the installation part.

REFERENCE NUMERALS

Figure 1:
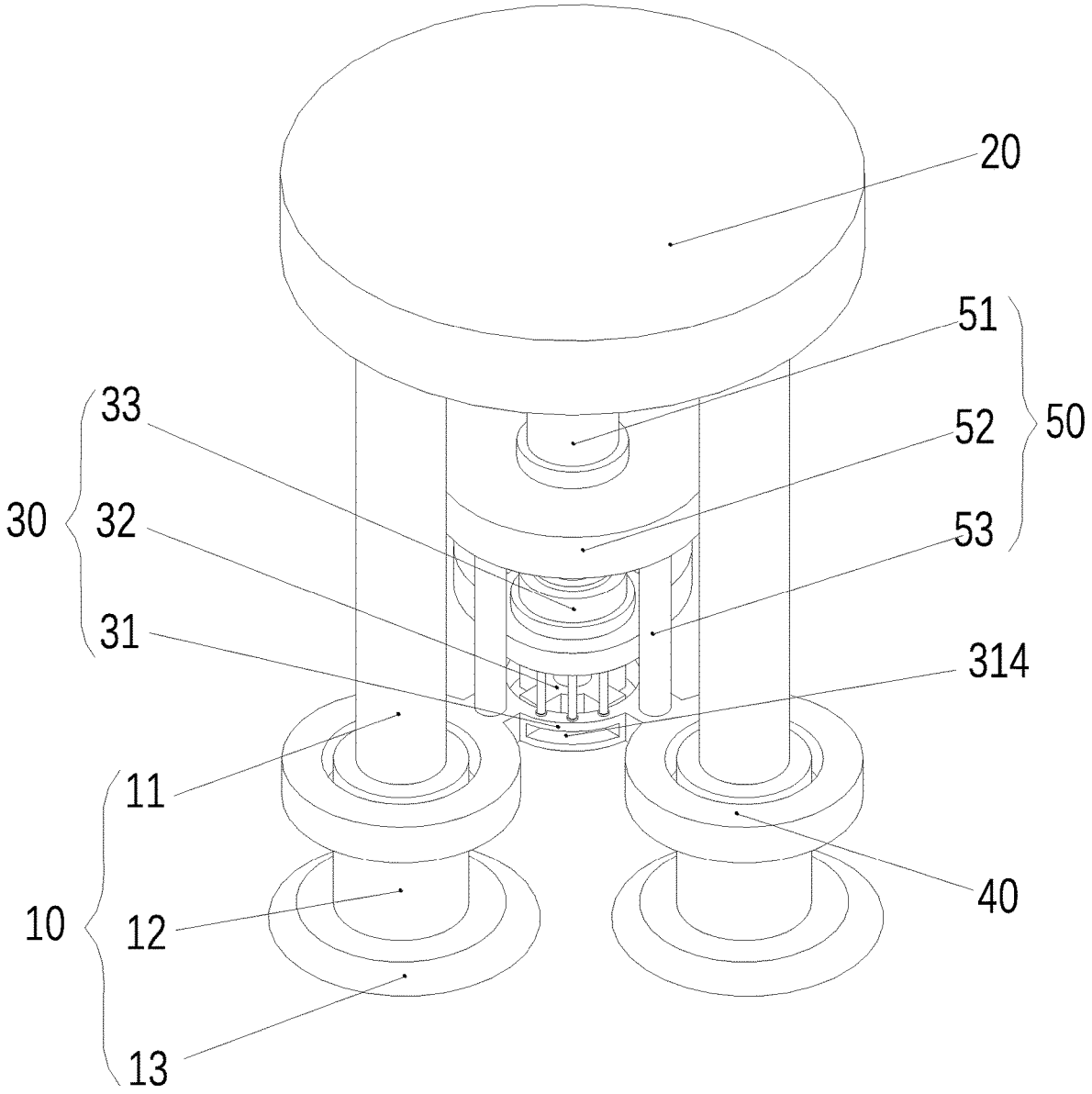
FIG. 1 is a perspective view of a self-maintaining and anti-scouring device for an offshore wind power pile foundation according to the present disclosure.

10 Fixing part
11 Stand column
12 Pre-embedded column
13 Base
20 Installation part
30 Sand-screening part
31 Sand-screening ring
32 Impeller
33 Waterproof motor
34 Installation seat
35 Sand-blocking net
36 Supporting rod
311 Seawater inlet
312 Stirring chamber
313 Sand outlet
314 Seawater outlet
40 Sand-pressing part
50 Lifting part
51 Hydraulic cylinder
52 Connecting plate
53 Connecting rod

DETAILED DESCRIPTION

In the following, embodiments of the present disclosure will be described in further detail with reference to the accompanying drawings. The embodiments are exemplary and are not to be construed as restricting the present disclosure.

It should be noted that terms such as "center", "longitudinal", "horizontal", "up", "down", "front", "back", "left", "right", "vertical", "horizontal", "top", "bottom", "inside", and "outside" indicate the orientation or position relationship based on those shown in the accompanying drawings. It is only for the convenience of describing and simplifying the description, and does not indicate or imply that the device or component mentioned must have a specific orientation, be constructed and operated in a specific orientation, and cannot be construed as restricting the present disclosure. In addition, the terms like "first" and "second" are used for indication purpose only, and are not to be construed as indicating or implying relative importance.

In the present disclosure, unless otherwise expressly specified, terms such as "installation", "connection", and "coupling" should be broadly understood. For example, when one element is referred to as being "connected to" another element, one element may be fixedly connected to, detachably connected to, or integrally connected to another element, may be mechanically connected to or electrically connected to another element, may be directly connected to another element, or may be indirectly connected to another element with another element interposed therebetween. These two elements may also communicate with each other internally. For those skilled in the art, the specific meanings of the above terms in the present disclosure can be understood based on specific situations.

In the present disclosure, "a plurality of" means two or more, unless otherwise expressly specified.

As shown in FIGS. 1 to 5, a self-maintaining and anti-scouring device for an offshore wind power pile foundation is provided to reinforce a sand-base layer around the wind power pile foundation, preventing wind power equipment from tilting and collapsing. The self-maintaining and anti-scouring device comprises:

- multiple fixing parts (10) configured to be fixedly disposed on seabed;
- an installation part (20) disposed at a top of the fixing parts (10) and used for installing wind power equipment;
- a sand-screening part (30), comprising a sand-screening ring (31) and an impeller (32) both of which are disposed below the installation part (20); the sand-screening ring (31) is substantially cylindrical, a top of the sand-screening ring (31) is configured as a seawater inlet (311), a bottom of the sand-screening ring (31) is configured as a sand outlet (313), a cavity of the sand-screening ring (31) is configured as a stirring chamber (312) for solid-liquid separation, and a seawater outlet (314) is disposed on a side surface of the sand-screening ring (31) to communicate to the stirring chamber (312); the impeller (32) is coaxially and horizontally rotatably disposed in the stirring chamber (312), and when the impeller (32) intermittently rotates within the stirring chamber (312), sand and seawater in the stirring chamber (312) can be separated through a centrifugal force, and the sand and the seawater are respectively discharged through the sand outlet (313) and the seawater outlet (314), at which time sand-containing seawater enters the stirring chamber (312) through the seawater inlet (311) of the sand-screening ring (31), thus realizing a circulation flow of seawater inside and outside the stirring chamber 312.

The present disclosure adopts the method of adding sand to reinforce the wind power pile foundation. The sand-screening ring 31 and the impeller 32 are both disposed below the installation part 20. When the impeller 32 rotates horizontally in the sand-screening ring 31, the sand-containing seawater in the stirring chamber 312 of the sand-screening ring 31 is carried along with the impeller 32, and is separated into the sand and seawater through the centrifugal force. The seawater can be discharged through the seawater outlet 314 disposed on the side surface of the sand-screening ring 31 under the action of the centrifugal force, while the sand gradually gathers on an inner surface of the sand-screening ring 31 under the action of the centrifugal force, and falls onto the fixing parts 10 through the sand outlet 313 disposed at the bottom of the sand-screening ring 31 under the action of the inner surface of the sand-screening ring 31. Thus, the wind power pile foundation is reinforced, and the detachment of the sand-base layer around the fixing parts 10 and the occurrence of scour holes, both caused by the scouring and impact of seawater, are avoided. Thus, the purpose of scour prevention can be achieved.

Figure 2:
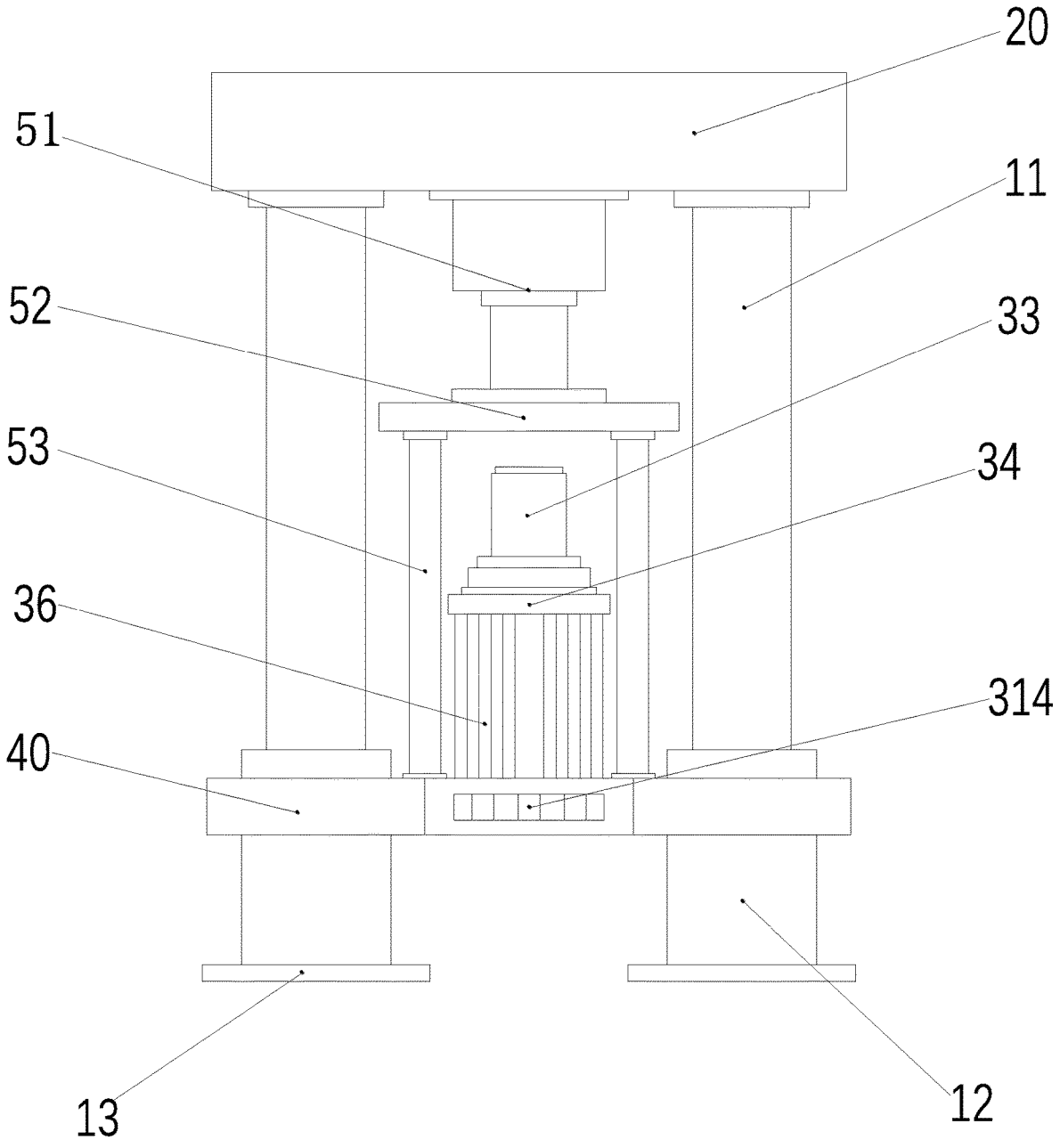
FIG. 2 is a front view of a self-maintaining and anti-scouring device for an offshore wind power pile foundation according to the present disclosure.
Figure 3:
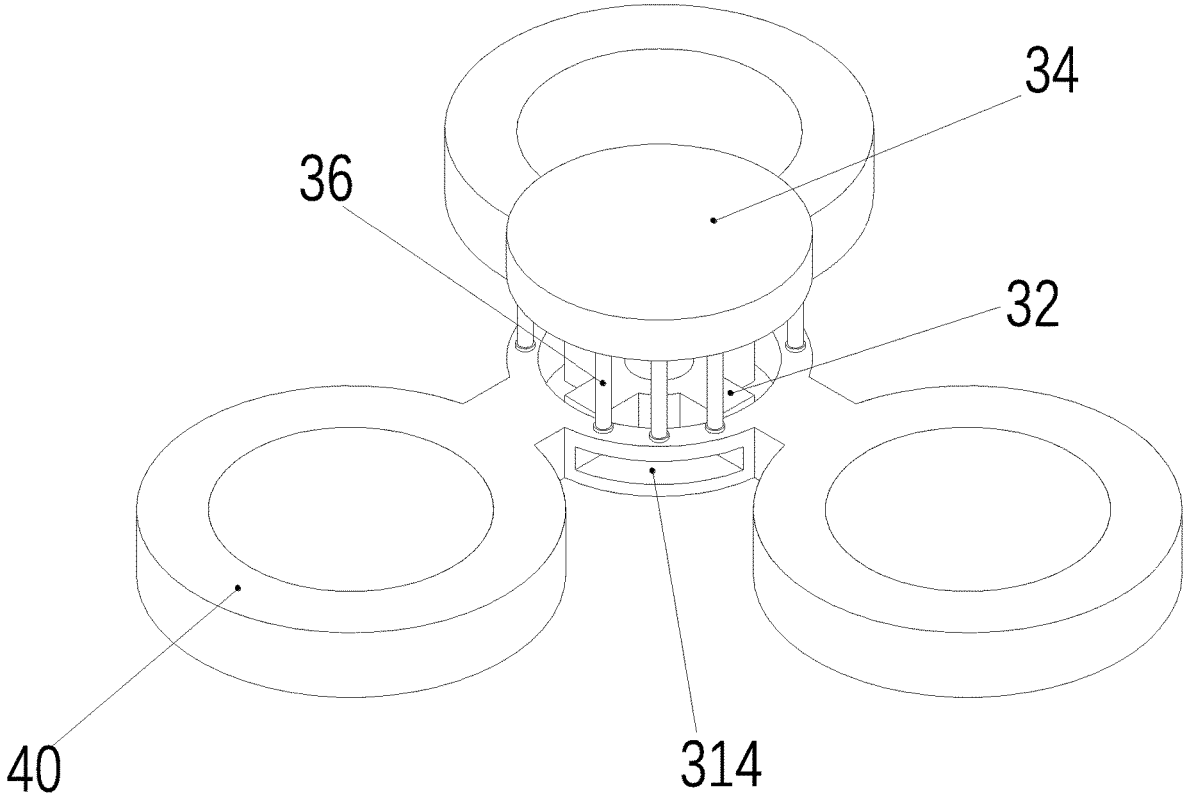
FIG. 3 is a schematic view illustrating a connection between a sand-screening part and sand-pressing parts.

In an embodiment, as shown in FIGS. 1 to 3, the self-maintaining and anti-scouring device further comprises multiple sand-pressing parts 40 and a lifting part 50. Each of the fixing parts 10 is sleeved with one movable sand-pressing part 40. The lifting part 50 is disposed below the installation part 20 for driving the sand-pressing parts 40 to ascend and descend. In this way, when the sand separated from the sand-screening part 30 falls to the periphery of the fixing parts 10 of the wind power pile foundation, the lifting part 50 can drive the sand-pressing parts 40 to ascend and descend relative to the fixing parts 10, thus reinforcing the sand around the fixing parts 10, and the sand-base layer around the fixing parts 10 can always be kept flat and dense. The self-repair of the sand-base layer for the wind power pile foundation can be achieved by the above method, thereby avoiding workers' underwater work and reducing maintenance costs.

Preferably, each of the sand-pressing parts 40 comprises a sand-pressing ring, and an inner hole of the sand-pressing ring is sleeved on the corresponding fixing part 10, so that the sand-pressing ring can ascend and descend along an axial direction of the fixing part 10.

More preferably, the lifting part 50 can be any mechanical structure that has a lifting function. An example of such a structure will be described in detail below. As shown in FIGS. 1 and 2, the lifting part 50 comprises a hydraulic cylinder 51, a connecting plate 52, and multiple connecting rods 53, and the installation part 20 comprises an installation base with a disk-shaped design. A cylinder terminal of the hydraulic cylinder 51 is located at a top of the hydraulic cylinder 51, and is coaxially and fixedly connected to the installation base. A piston terminal of the hydraulic cylinder 51 is located at a bottom of the hydraulic cylinder 51, and is coaxially and fixedly connected to the connecting plate 52. Multiple connecting rods 53 are circumferentially and evenly distributed around the axis of the connecting plate 52. A top of each connecting rod 53 is fixedly connected to the connecting plate 52, and a bottom of each connecting rod 53 is fixedly connected to the corresponding sand-pressing part 40. In this way, the sand-pressing parts 40 can be driven to ascend and descend relative to the fixing parts 10 by utilizing the expansion and contraction of the hydraulic cylinder 51, thus reinforcing the sand around the fixing parts 10.

It should be noted that, during the expansion and contraction of the hydraulic cylinder 51, the hydraulic cylinder 51 must always be located above the sea surface. This design can not only prevent the hydraulic cylinder 51 from being submerged in seawater, which results in poor driving force, but also protects the hydraulic cylinder 51 from seawater erosion, thereby extending the service life of the entire device.

In an embodiment, as shown in FIGS. 1 and 2, the sand-screening part 30 further comprises a waterproof motor 33 and an installation seat 34. The installation seat 34 is disposed between the sand-screening ring 31 and the connecting plate 52, and is fixedly disposed above the sand-screening ring 31 through multiple supporting rods 36. The waterproof motor 33 is fixedly installed on the installation seat 34, and a power output shaft of the waterproof motor 33 penetrates the installation seat 34, and is transmitted to the impeller 32 disposed within the stirring chamber 312. In this way, the waterproof motor 33 is fixedly disposed above the sand-screening ring 31 by utilizing the installation seat 34 and multiple supporting rods 36, and the power output shaft of the waterproof motor 33 drives the impeller 32 to rotate, thereby separating the sand-containing seawater in the stirring chamber 312 into the sand and seawater, and realizing a circulation flow of seawater inside and outside the stirring chamber 312. Therefore, the sand-containing seawater around the wind power pile foundation can be introduced into the stirring chamber 312 through the seawater inlet disposed at the top of the sand-screening ring 31, then the seawater is discharged through the seawater outlet 314 disposed on the side surface of the sand-screening ring 31, and the sand gathering in the stirring chamber 312 falls down.

Preferably, the waterproof motor 33 has a waterproof shell. The waterproof shell can prevent the seawater from entering and damaging the waterproof motor 33, which soaks in seawater for a long time, thereby playing a role in waterproof isolation.

More preferably, a surface of the impeller 32 is coated with an anti-rust and anti-corrosion coating. In this way, by coating anti-rust and anti-corrosion coatings on the surface of the impeller 32, the overall service life of the impeller 32 is improved, and maintenance time and frequency are reduced, thereby achieving the purpose of easy maintenance.

In an embodiment, as shown in FIGS. 1 to 4, multiple sand-pressing parts 40 are disposed around the sand-screening ring 31. The side surface of the sand-screening ring 31 is fixedly connected to a side surface of each sand-pressing part 40, and a bottom surface of the sand-screening ring 31 is flush with those of the sand-pressing parts 40. In this way, the sand around the fixing parts 10 can be reinforced by utilizing the sand-pressing parts 40 and the sand-screening ring 31, so that the sand-base layer around the fixing parts 10 can be kept flat, thereby achieving the purpose of facilitating reinforcement.

Figure 5:
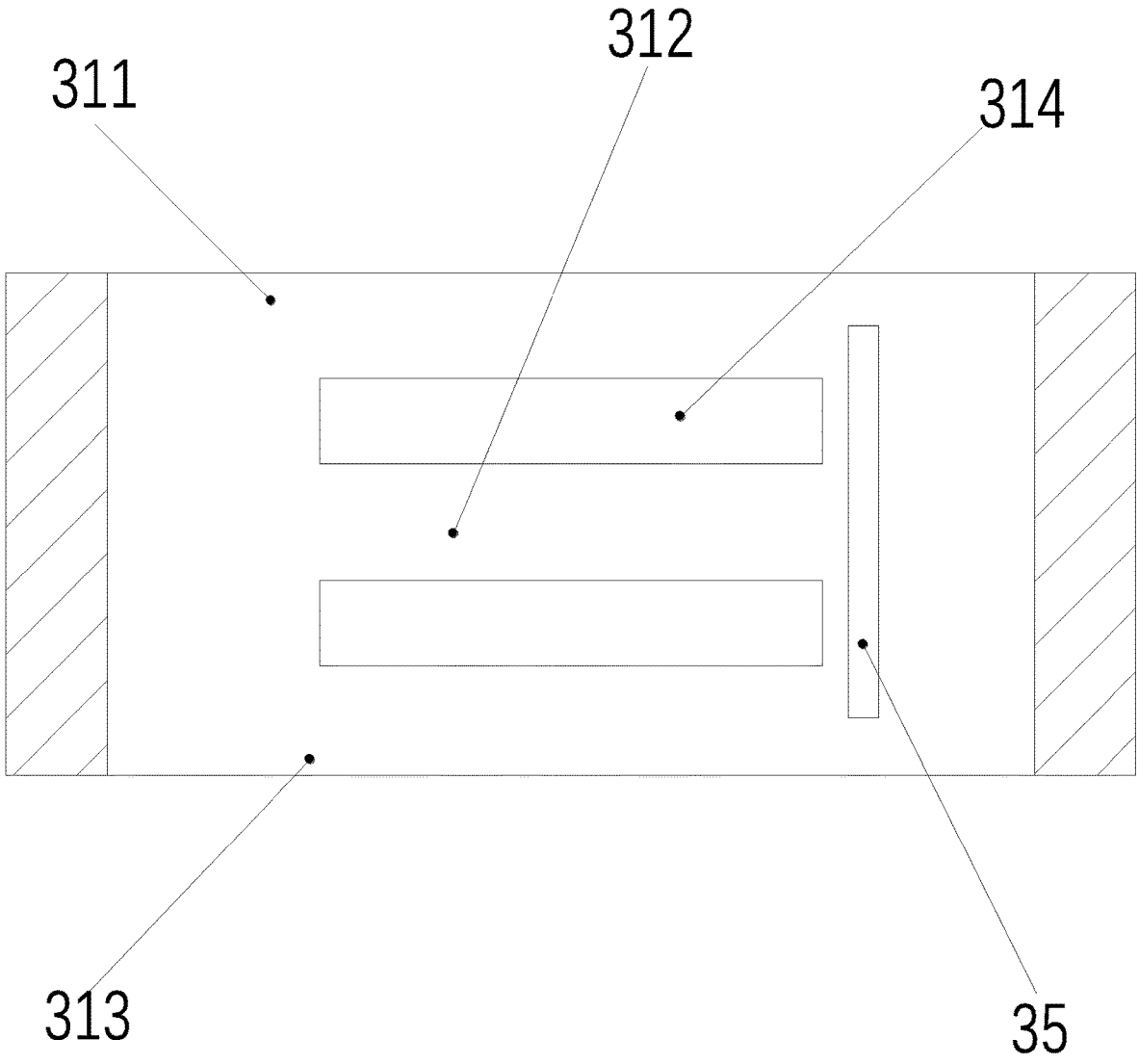
FIG. 5 is a schematic structural view of a sand-screening ring.

In an embodiment, as shown in FIG. 5, a radial dimension of the impeller 32 is smaller than an inner diameter of the sand-screening ring 31, so that a gap is formed between the impeller 32 and the sand-screening ring 31. A sand-blocking net 35 is disposed in the gap along an axial direction of the sand-screening ring 31, and has a one-to-one correspondence with the seawater outlet 314. The sand-blocking net 35 is disposed upstream of the seawater outlet 314. In this way, after separating the sand-containing seawater into the sand and seawater through the centrifugal force, the seawater bears a small centrifugal force and is discharged through the seawater outlet 314 without being affected by the sand-blocking net 35, and the sand bears a large centrifugal force and is gathered to the gap and the inner surface of the sand-screening ring 31. With the flow of seawater, part of the sand in the gap will be discharged through the seawater outlet 314 along with the seawater, rendering this part of the sand unusable. By disposing the sand-blocking net 35 upstream of the seawater outlet 314, the sand carried by seawater in the gap is intercepted, and falls to the periphery of the fixing parts 10 under the action of a gravitational force, maximizing sand utilization.

Figure 4:
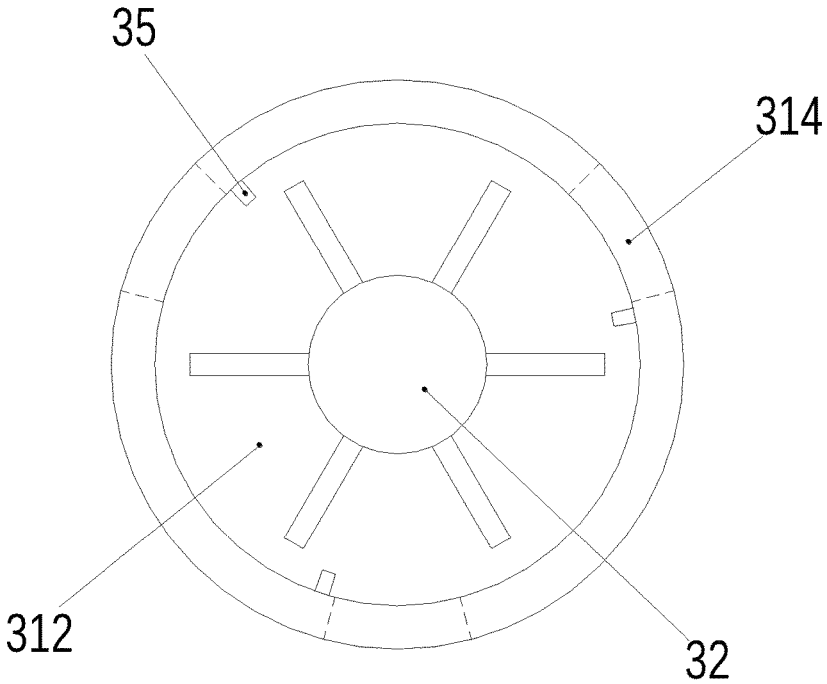
FIG. 4 is a top view illustrating a positional relationship between a sand-screening ring and an impeller.

In an embodiment, as shown in FIGS. 2 to 4, the seawater outlet 314 is a strip-shaped slot disposed along a circumferential direction of the sand-screening ring 31. In this way, the seawater outlet 314 being a strip-shaped slot facilitates the seawater in the stirring chamber 312 to discharge, and reduces a dimension of the seawater outlet 314 along the axial direction of the sand-screening ring 31, thus preventing the sand from being carried out by seawater. Meanwhile, under the action of the centrifugal force, the seawater discharged through the strip-shaped slot can not only stir the seawater around the wind power pile foundation, but also reduce the impact of waves on the wind power pile foundation.

In an embodiment, as shown in FIGS. 1 and 3, multiple fixing parts 10, for example, two or three, are provided, and each fixing part corresponds one-to-one with one of the sand-pressing parts 40. When the number of the fixing parts 10 is three, the fixing parts should be disposed at vertices of an equilateral triangle, and each of the fixing parts 10 is provided with a base 13 for abutting against the seabed. Compared with a single support structure, a more stable support structure is obtained by supporting the installation base with multiple fixing parts 10. When the wind power pile foundation bears the impact of waves, the wind power equipment installed on the installation base will remain stable and not shake, thereby achieving the purpose of stabilizing the structure.

Preferably, each of the fixing parts 10 comprises a stand column 11 and a pre-embedded column 12. A top of the pre-embedded column 12 is coaxially and fixedly connected to the stand column 11, and a bottom of the pre-embedded column 12 is embedded into a pre-embedded hole in the seabed. The base 13 is reinforced in the seabed, and the installation base, the stand column 11 and the pre-embedded column 12 are formed integrally. Compared with fixing and welding the wind power equipment with connecting pieces, a main body with an integral structure can be obtained by reinforcing the pre-embedded column 12 into the pre-embedded hole and integrally forming the installation base, the stand column 11 and the pre-embedded column 12. This structure improves the impact resistance of the wind power equipment.

The application process for the self-maintaining and anti-scouring device of the present disclosure is as follows:

When the device is in use, the hydraulic cylinder 51 and the waterproof motor 33 that are used in conjunction with each other are first installed below the installation base and fixed, respectively, then the stand column 11 and the pre-embedded column 12 of the wind power pile foundation are submerged in seawater, and the pre-embedded column 12 goes deep into the pre-embedded hole in the seabed and is fixed. Finally, the wind power equipment is fixedly installed on the installation base. When the waves scour the stand column 11, the waterproof motor 33 is started, and the power output shaft of the waterproof motor 33 drives the impeller 32 to rotate for stirring the sand-containing seawater in the stirring chamber 312. The sand and the seawater are separated through the centrifugal force, and the seawater will be discharged through the seawater outlet 314 disposed on the side surface of the sand-screening ring 31 and stir the seawater around the wind power pile foundation. With the flow of the seawater, the sand will be carried along with the seawater and enter the stirring chamber 312 through the seawater inlet 311 disposed at the top of the sand-screening ring 31, thereby allowing the remotely located sand to be sucked to the periphery of the wind power pile foundation. The sand-pressing parts 40 are used for reinforcing the sand around the pre-embedded column 12, thus the nearby sand-base layer can always be kept flat, avoiding the occurrence of scour holes caused by the scouring and impact of seawater. Thereby, the purpose of scour prevention can be achieved.

Compared with the existing technology, the present disclosure has the following beneficial technical effects:

1. In the present disclosure, the sand-screening ring 31 and the impeller 32 are both disposed below the installation base. When the impeller 32 rotates in the stirring chamber 312, the sand-containing seawater in the stirring chamber 312 is separated into the sand and the seawater through the centrifugal force. The seawater can be discharged through the seawater outlet 314 disposed on the side surface of the sand-screening ring 31, and the sand around the installation base can be carried along with the seawater to move below the installation base. With the flow of the seawater, the sand around the wind power pile foundation can also be sucked below the installation base. Thus, the detachment of the sand-base layer around the stand column 11 and the pre-embedded column 12 and the occurrence of the scour holes, both caused by the scouring and impact of seawater, are avoided. Thereby, the purpose of scour prevention can be achieved.

2. In the present disclosure, the hydraulic cylinder 51 is disposed below the installation base, and the hydraulic cylinder 51 is connected to the sand-pressing part 40 disposed on the corresponding pre-embedded column 12. When the waterproof motor 33 is running or after it has run, the hydraulic cylinder 51 drives the sand-screening ring 31 and the sand-pressing part 40 to ascend and descend along the axial direction of the fixing part 10. When the sand-screening ring 31 and the sand-pressing part 40 move downward simultaneously, the sand below the installation base can be reinforced at the periphery of the pre-embedded column 12, and the sand-base layer around the pre-embedded column 12 can always be kept flat and dense, thereby achieving the self-repair of the sand-base layer for the wind power pile foundation, avoiding workers' underwater work, and reducing maintenance costs.

The above-mentioned embodiments are illustrative. It should be noted that those skilled in the art can make various improvements and transformations without departing from the technical principles of the present disclosure. These improvements and transformations shall be still covered by the scope of the present disclosure.

What is claimed is:

1. A self-maintaining and anti-scouring device for an offshore wind power pile foundation, comprising:

a plurality of fixing parts (10) configured to be fixedly disposed on seabed;

an installation part (20) disposed above the plurality of fixing parts (10) and configured for installing wind power equipment;

a sand-screening part (30), comprising a sand-screening ring (31) and an impeller (32) both of which are disposed below the installation part (20), wherein a seawater inlet (311), a stirring chamber (312) and a sand outlet (313) are disposed on the sand-screening ring (31) in sequence from a top to a bottom of the sand-screening ring (31), and a seawater outlet (314) is disposed on a side surface of the sand-screening ring (31) to communicate to the stirring chamber (312), wherein the impeller (32) is horizontally and rotatably disposed in the stirring chamber (312) to separate sand and seawater in the stirring chamber (312) through a centrifugal force, wherein the sand and the seawater are discharged through the sand outlet (313) and the seawater outlet (314) respectively, at which time sand-containing seawater enters the stirring chamber (312) through the seawater inlet (311); and a plurality of sand-pressing parts (40) and a lifting part (50), wherein each of the plurality of fixing parts (10) is sleeved with one of the plurality of sand-pressing parts (40), wherein the lifting part (50) is disposed below the installation part (20) for driving the plurality of sand-pressing parts (40) to ascend and descend;

wherein the lifting part (50) comprises a hydraulic cylinder (51), a connecting plate (52), and a plurality of connecting rods (53), wherein a top of the hydraulic cylinder (51) is fixedly connected to the installation part (20), a bottom of the hydraulic cylinder (51) is fixedly connected to the connecting plate (52), and the connecting plate (52) is fixedly connected to the plurality of sand-pressing parts (40) through the plurality of connecting rods (53).

2. The self-maintaining and anti-scouring device for the offshore wind power pile foundation according to claim 1, wherein the sand-screening part (30) further comprises a waterproof motor (33) and an installation seat (34), wherein the installation seat (34) is fixedly disposed above the sand-screening ring (31) through a plurality of supporting rods (36), wherein the installation seat (34) is disposed below the connecting plate (52), and the waterproof motor (33) is fixedly installed on the installation seat (34).

3. The self-maintaining and anti-scouring device for the offshore wind power pile foundation according to claim 2, wherein the sand-screening ring (31) is fixedly connected to the plurality of sand-pressing parts (40), and a bottom surface of the sand-screening ring (31) is flush with those of the plurality of sand-pressing parts (40).

4. The self-maintaining and anti-scouring device for the offshore wind power pile foundation according to claim 1, wherein a gap is formed between the impeller (32) and the sand-screening ring (31), wherein a sand-blocking net (35) is disposed in the gap along an axial direction of the sand-screening ring (31), and the sand-blocking net (35) is disposed upstream of the seawater outlet (314).

5. The self-maintaining and anti-scouring device for the offshore wind power pile foundation according to claim 4, wherein the seawater outlet (314) is a strip-shaped slot disposed along a circumferential direction of the sand-screening ring (31).

6. The self-maintaining and anti-scouring device for the offshore wind power pile foundation according to claim 1, wherein the number of the plurality of fixing parts (10) is two or three, and each of the plurality of fixing parts (10) is provided with a base (13) for abutting against the seabed.

7. The self-maintaining and anti-scouring device for the offshore wind power pile foundation according to claim 6, wherein each of the plurality of fixing parts (10) comprises a stand column (11) and a pre-embedded column (12), which are disposed and connected to each other along their common axial direction, wherein a bottom of the pre-embedded column (12) is embedded into the seabed, and a top of the stand column (11) is fixedly connected to the installation part (20).

8. The self-maintaining and anti-scouring device for the offshore wind power pile foundation according to claim 7, wherein the installation part (20) comprises an installation base, and the installation base, the stand column (11) and the pre-embedded column (12) are integrally formed.

* * * * *